US006830272B1

(12) United States Patent
Bailey

(10) Patent No.: US 6,830,272 B1
(45) Date of Patent: Dec. 14, 2004

(54) PICK-UP TRUCK BOX REMOVAL TOOL

(76) Inventor: Rick H. Bailey, 1000 Ubly Rd., Bad Axe, MI (US) 48413

( * ) Notice: Subject to any disclaimer, the term of this patent is extended or adjusted under 35 U.S.C. 154(b) by 50 days.

(21) Appl. No.: 10/267,805

(22) Filed: Oct. 9, 2002

Related U.S. Application Data

(60) Provisional application No. 60/328,024, filed on Oct. 9, 2001.

(51) Int. Cl.[7] ..... B66C 1/66

(52) U.S. Cl. ..... 294/67.33; 414/620; 414/812

(58) Field of Search ..... 269/17; 414/345, 414/347, 495, 498, 618, 619, 610, 812; 294/67.33, 67.5

(56) References Cited

U.S. PATENT DOCUMENTS

| | | | | |
|---|---|---|---|---|
| 3,752,463 A | * | 8/1973 | Schilke | 269/17 |
| 4,190,233 A | | 2/1980 | Godfrey | |
| 4,932,639 A | | 6/1990 | Fjellstrom | |
| 5,269,501 A | | 12/1993 | Liegel et al. | |
| 5,549,287 A | | 8/1996 | Loucks | |
| 5,803,520 A | * | 9/1998 | Bagrowski, III | 294/67.33 |
| 5,839,876 A | | 11/1998 | McCarthy et al. | |
| 5,862,885 A | | 1/1999 | Carmitchel | |
| 5,863,034 A | | 1/1999 | Vauter | |
| 5,915,742 A | * | 6/1999 | Hung | 29/281.5 |
| 6,042,165 A | * | 3/2000 | Thompson | 294/67.32 |
| 6,170,802 B1 | * | 1/2001 | Stovall | 254/8 R |
| 6,533,260 B1 | * | 3/2003 | Mock | 269/17 |
| 6,612,548 B2 | * | 9/2003 | Landreth et al. | 254/8 R |

FOREIGN PATENT DOCUMENTS

| | | | | |
|---|---|---|---|---|
| GB | 163556 | * | 5/1921 | 414/495 |
| JP | 9165116 | * | 6/1997 | |

* cited by examiner

*Primary Examiner*—Eileen D. Lillis
*Assistant Examiner*—Charles A. Fox
(74) *Attorney, Agent, or Firm*—Reising, Ethington, Barnes, Kisselle & Learman, P.C.

(57) ABSTRACT

The pick-up cargo box removal tool includes a generally vertical mast attached to a carriage supported by wheels. A slider assembly is slidably mounted on the mast. A winch is mounted on the slider assembly. A winch has a winch cable that extends from a winch drum, over a cable guide pulley journaled on the mast, and has a free cable end attached to the slider assembly. The rear end of a cargo box is pivotally connected to the slider assembly for pivotal movement about a transverse horizontal axis. The front portion of the cargo box is supported by two side rail engaging plates. The side rail engaging plates are secured to the slider assembly and are adjustable vertically relative to the slider assembly.

17 Claims, 6 Drawing Sheets

172
158
154
160
148
232
134
126
114
206
192
230
116
282
284
152
194
136
128
196
216
190
186
70
216
18
72
74
76
26
56
24
28
54
30
32
34
58
64
38
50
48
66
52
60
62
68

FIG - 2
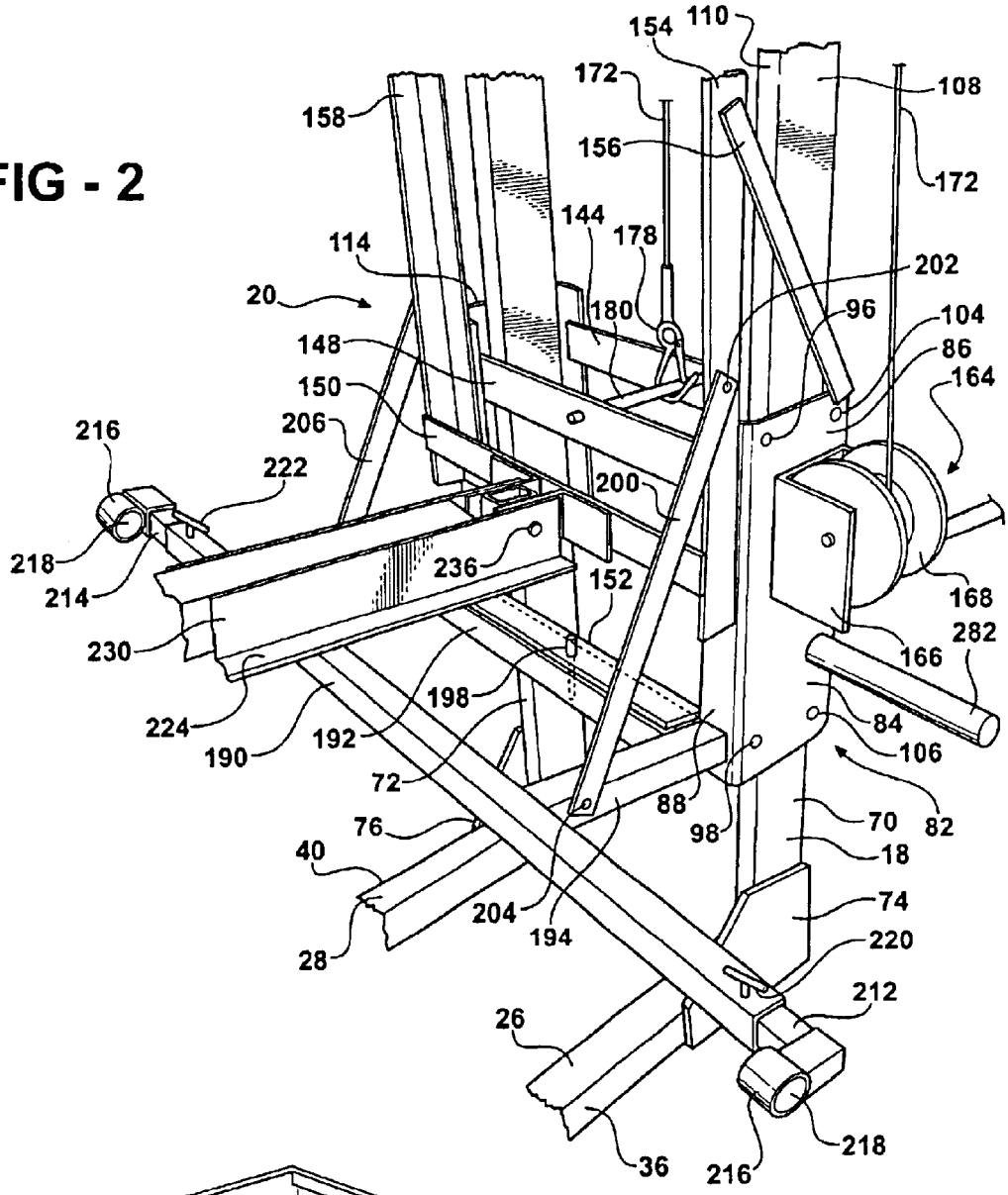
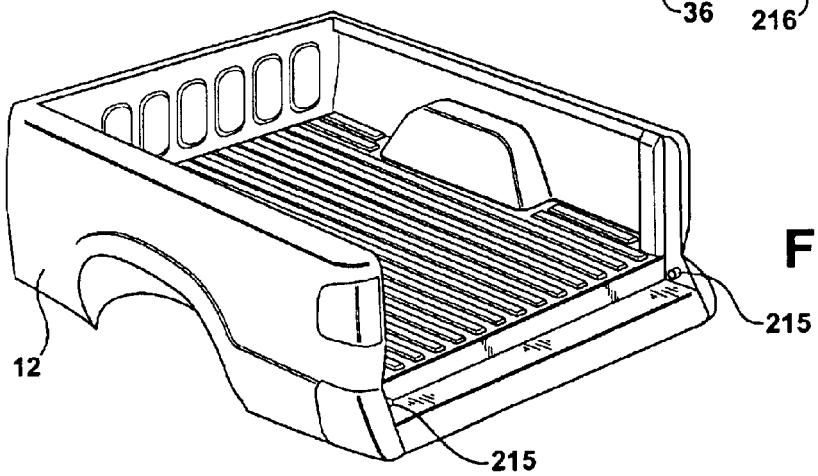
FIG - 9

PICK-UP TRUCK BOX REMOVAL TOOL

TECHNICAL FIELD

The pick-up truck box removal tool permits removal of a cargo box from a light truck for repair of the box or the truck and replacement of the box following completion of the repair without assistance from another individual. The disclosure incorporates the vehicle body repair tool and methods disclosed in provisional patent application Ser. No. 60/328,024, filed Oct. 9, 2001, whose priority is claimed for this application.

BACKGROUND OF THE INVENTION

Large bridge cranes and A-frame hoists are available to lift objects with a range of weights. These lifting devices are generally designed to lift relatively heavy objects. As a result of their size and strength, these devices are relatively expensive and are not available in many vehicle and vehicle body repair shops.

Specialized lifting tools are available for lifting specific vehicle components. Such tools are generally designed to lift one specific item only. The item can, for example, be a transmission, an engine, a door or even a hood. Such tools do not have excess lifting capacity and could not be modified to handle a substantial range of vehicle parts.

A few lifting tools, such as the vehicle body repair tool disclosed in my allowed U.S. patent application Ser. No. 09/798,234 filed Mar. 2, 2001 and now U.S. Pat. No. 6,490,906, the disclosure of which is incorporated herein by reference, are designed with accessories to perform a variety of relatively common tasks. Many vehicle repair facilities have become specialized in recent years. As a result, they do not need a tool with a variety of accessories for lifting tasks that they do not encounter in their work. For these specialized repair facilities, a tool with several accessories for different lifting tasks are considered to be too expensive.

Large numbers of pick-up trucks are manufactured and sold today. Their popularity is due to a number of capabilities including the ability to transport cargo which will not fit into an automobile, their durability and their relatively low repair costs. Many of these pick-up trucks have fuel tanks mounted in the frame and a fuel pump mounted inside the fuel tank. With the proper tool, fuel pumps and fuel tank problems can be repaired in less time by removing the cargo box first. Removal of the cargo box can also be a timesaver when repairing the truck frame, the rear axle, the suspension system or the cargo box.

Many lifting tools that can be used to remove pick-up truck boxes suspend the box from one or two cables. Any load suspended from one cable is free to rotate about the axis of the cable. In addition to rotating, such loads can swing in any direction and may also be able to tilt. Loads suspended from two cables can swing and may also tilt. To prevent damage to light trucks and pick-up truck boxes, it may be necessary to have two or more people hold a pick-up truck box steady while others control the lifting machine.

SUMMARY OF THE INVENTION

The pick-up truck box removal tool 10 has a carriage frame supported by a plurality of wheels. A generally vertical mast has a lower end secured to the carriage frame and an upper mast end. A slider assembly is mounted on the generally vertical mast and is slidable along at least a portion of the generally vertical mast between the mast lower end and the mast upper end. A slider actuator, carried by the carriage frame and connected to the slider assembly, is operable to lift and lower the slider assembly on the generally vertical mast. A truck box rear holder includes a rear transverse bar connected to the slider assembly and held in a fixed position relative to the slider assembly, a left tailgate pivot stud receiver adjustably mounted on the rear transverse bar and a right tailgate pivot stud receiver adjustably mounted on the rear transverse bar. A truck box front holder includes a compression beam having a compression beam rear end pivotally attached to the slider assembly and pivotable about a transverse horizontal front axis holder, at least one length adjustment pole adjustably connected to the compression beam. A transverse front pole is pivotally attached to the at least one length adjustment pole and is movable toward and away from the slider assembly with the at least one length adjustment pole. A left truck box side rail engaging plate is adjustably connected to the transverse front pole. A right truck box side rail engaging plate is adjustably connected to the transverse front pole. An adjustable length assembly has a first end connected to the slider assembly and a second end connected to the compression beam at a position spaced from the transverse horizontal front holder axis and is operable to raise and lower the transverse front pole relative to the truck box rear holder.

BRIEF DESCRIPTION OF THE DRAWINGS

The presently preferred embodiment of the invention is disclosed in the following description and in the accompanying drawings, wherein:

FIG. 2 is an enlarged perspective view of the slider assembly with parts broken away;

FIG. 9 is a perspective view of the rear portion of the pick-up cargo box with the tailgate removed and with parts broken away.

DETAILED DESCRIPTION OF THE PREFERRED EMBODIMENT

Figure 1:
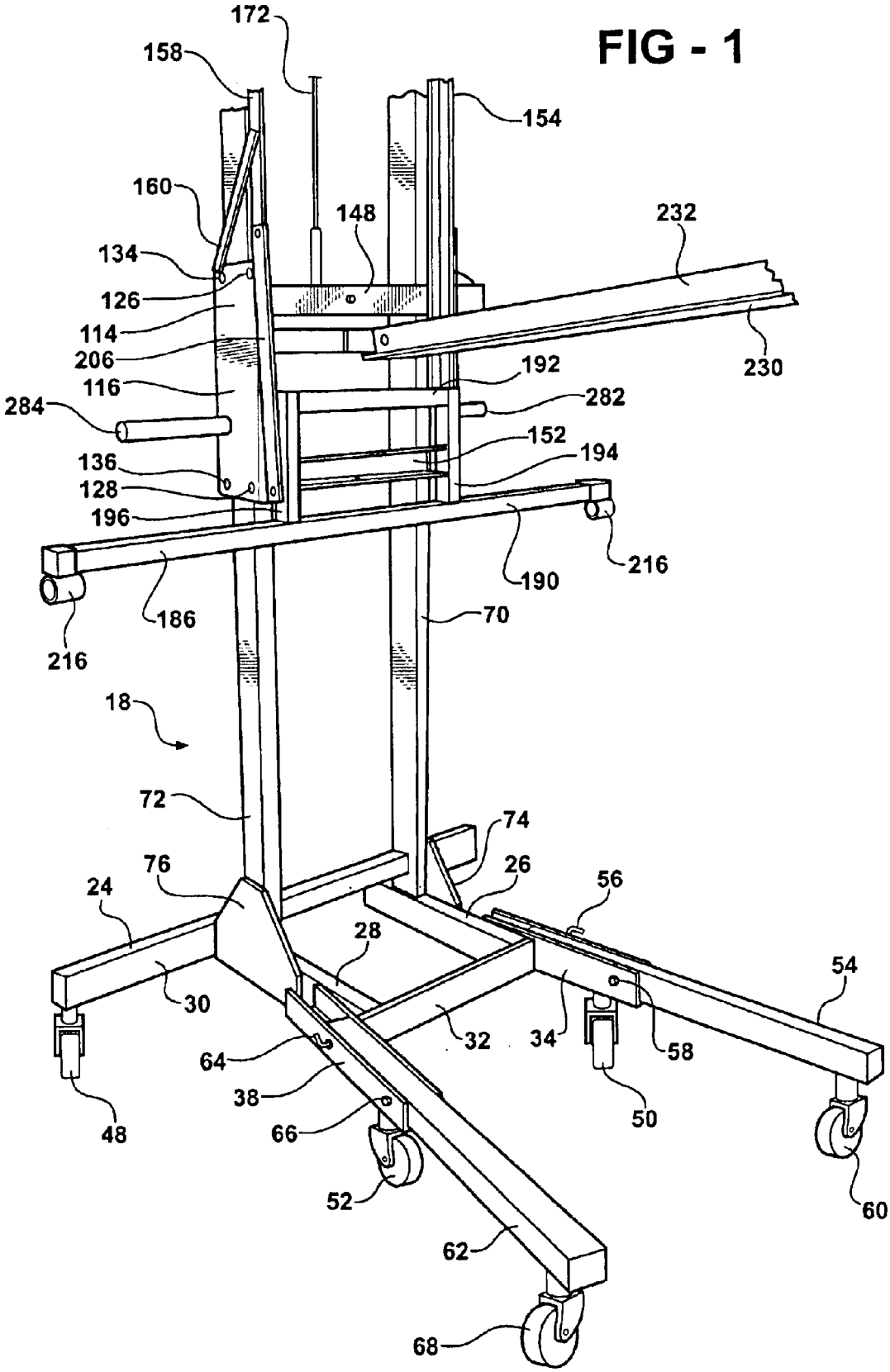
FIG. 1 is a perspective view of the cargo box removal tool with parts broken away and with the truck box rear holder in a storage position.

Terms such as left, right, front and rear are as seen by a person standing behind a pick-up truck and facing in the normal direction of forward movement. The term transverse refers to a direction that is transverse to the normal direction of forward and reverse movement of the pick-up truck. When the terms set forth above relate to the pick-up truck cargo box removal tool 10, they refer to the tool as seen when the tool is in position to remove or replace a truck cargo box 12 and the person observing the tool is to the rear of the pick-up truck and behind the tool and facing in the normal direction of forward movement of the truck.

The pick-up truck cargo box removal tool 10 for removing a cargo box 12 from a pick-up truck frame 14 includes a carriage 16, a mast assembly 18, a lift unit 20, and a box holder assembly 22. The carriage 16 includes an elongated horizontal transverse tubular beam 24 with a rectangular cross section. Two parallel fore and aft horizontal tubular beams 26 and 28 have rear ends that are welded to a front side 30 of the transverse tubular beam 24. The tubular beams 26 and 28 have a rectangular cross section. A transverse plate 32 is welded to the forward ends of the fore and aft tubular beams 26 and 28. A left side horizontal channel member 34 with an open top is welded to a left side 36 of the tubular beam 26 and to the left end of the horizontal plate 32. A right side horizontal channel member 38 with an open top is welded to the right side 40 of the tubular beam 28 and to the right end of the transverse plate 32. The transverse plate 32 extends outward from the left side 36 of the fore and aft beam 26 a short distance. The transverse plate 32 also extends outward from the right side 40 of the fore and aft beam 28 a short distance. As a result, the free ends 42 and 44 of the left and right side channel members 34 and 38 diverge from each other. A left rear caster wheel 46 is attached to the left end of the transverse beam 24. A right rear caster wheel 48 is attached to the right end of the transverse beam 24. A left front caster wheel 50 is attached to the free end 42 of the left side channel member 34. A right front caster wheel 52 is attached to the free end 44 of the right side channel member 38.

A left outrigger 54 is received in the left channel member 34 and retained by a pivot pin 56. A left outrigger lock pin 58 passes through the left channel member 34 and the left outrigger 54 to lock the outrigger in a horizontal position. A left outrigger caster wheel 60 on the forward free end of the outrigger 54 stabilizes the carriage 16 when the outrigger is locked by the lock pin 58. A right outrigger 62 is received in the right channel member 38 and retained by a pivot pin 64. A right outrigger lock pin 66 passes through the right channel member 38 and the right outrigger 62 to lock the outrigger in a horizontal position. A right outrigger caster wheel 68 on the forward free end of the outrigger 62 stabilizes the carriage 16 when the outrigger is locked by the lock pin 66.

The mast assembly 18 includes left and right generally vertical rectangular mast tubes 70 and 72 that are spaced apart and parallel to each other. The bottom end of the left mast tube 70 is welded to the fore and aft beam 26 between the transverse beam 24 and the transverse plate 32. A gusset 74 strengthens the connection between the left mast tube 70 and the fore and aft beam 26. The bottom end of the right mast tube 72 is welded to the fore and aft beam 28 between the transverse beam 24 and the transverse plate 32. A gusset 76 strengthens the connection between the right mast tube 72 and the fore and aft beam 28. The connections between the carriage 16 and the left and right mast tubes 70 and 72 angle the upper ends of both tubes rearward a few degrees from vertical relative to the horizontal carriage 16 so that when the mast is heavily loaded, both mast tubes are substantially vertical.

A pair of horizontal spaced apart angle irons 80 are welded to the upper ends of the left and right mast tubes 70 and 72 to hold the mast tubes in a spaced apart parallel position relative to each other.

The lift unit 20 includes a slider assembly 82. The slider assembly 82 includes a left channel member 84 with a vertical fore and aft web 86, an integral front flange 88 and an integral rear flange 90. A front upper roller 92 and a front lower roller 94 are mounted in the channel of the left channel member 84 by bolts 96 and 98 that clamp the rollers to the inside surface of the web 86. A rear upper roller 100 and a rear lower roller 102 are mounted in the channel of the left channel member by bolts 104 and 106 that clamp the rollers to the inside surface of the web 86. The left mast tube 70 is received in the channel of the left channel member 84 with the web 86 adjacent to a left side wall 108 of the left mast tube, the front rollers 94 in engagement with a front wall 110, and with the rear rollers 102 in engagement with the rear wall 112 of the left mast tube. The slider assembly 82 also includes a right channel member 114 with a vertical fore and aft web 116, an integral front flange 118 and an integral rear flange 120. A front upper roller and a front lower roller 124 are mounted in the channel of the right channel member 114 by bolts 126 and 128 that clamp the rollers to the inside surface of the web 116. A rear upper roller and a rear lower roller 132 are mounted in the channel of the right channel member 114 by bolts 134 and 136 that clamp the rollers to the inside surface of the web 116. The right mast tube 72 is received in the channel of the right channel member 114 with a web 116 adjacent to a right side wall 138 of the right mast tube, the front rollers 124 in engagement with a front wall 140 of the right mast tube, and with the rear rollers 132 in engagement with a rear wall 142 of the right mast tube. If desired, some or all of the rollers 94, 102, 124 and 132 can be replaced by slide bearings made from strips of low friction material.

A plurality of rear cross bars 144 and 146 are attached to the rear flanges 90 and 120 of the left channel member 84 and the right channel member 114 by welding. A plurality of front cross members 148, 150 and 152 are attached to the front flanges 88 and 118 of the left channel member 84 and the right channel member 114 by welding. The lower front cross member 152 is a channel shaped member with its front side open.

A vertical left angle iron 154 is attached to the front flange 88 of the left channel member 84 and extends vertically upward from the left channel member. A left tension strap 156 is attached to an upper rear corner of the web 86 of the left channel member 84 and to an upper portion of the vertical left angle iron 154. A vertical right angle iron 158 is attached to the front flange 118 of the right channel member 114 and extends vertically upward from the right channel member. A right tension strap 160 is attached to an upper rear corner of the web 116 of the right channel member 114 and to an upper portion of the vertical right angle iron 158. A horizontal cross bar 162 is connected to the upper ends of the vertical left angle iron 154 and the vertical right angle iron 158.

The lift unit 20, as shown in the drawing, also includes a winch assembly 164. The winch assembly 164 includes a winch housing 166 attached to the left channel member 84 of the slider assembly 82. A winch drum 168 is journaled into the winch housing 166. A hand crank 170 rotates the winch drum 168 through reduction gears (not shown) to wind a cable 172 on the winch drum or to unwind the cable from the winch drum. The winch drum 168 is locked to prevent the winch drum from rotating when the crank 170 is not being manually rotated, by a lock mechanism (not shown). The winch assembly 164, as described above, is one of many commercially available winches that can be used. The cable 172 extends substantially vertically upward, around two guide pulleys 174 and 176 and substantially vertically downward to an attached cable end hook 178. The hook 178 is attached to a horizontal rod 180 that passes through the front cross member 148 and the rear cross member 144 of the slider assembly 82. The guide pulley 174 is journaled on a horizontal pin 182 that passes through angle irons 80 above the left mast tube 70. The guide pulley 176 is journaled on a horizontal pin 184 that passes through the angle irons 80 and supports a vertical run of the cable 172 midway between the left mast tube 70 and the right mast tube 72. Both guide pulleys 174 and 176 are between the angle irons 78 and 80 and are axially positioned by the angle irons.

The winch assembly 164, as described above, is manually operated. A powered winch could be used if desired. A linear actuator, such as a hydraulic cylinder or a screw-driven unit, can be connected to the slider assembly 82 and move the slider vertically along the mast tubes 70 and 72.

The box holder assembly 22, for attaching a pick-up cargo box 12 to the slider assembly 82, includes a box rear holder 186 and a box front holder 188. The box rear holder 186 includes a transverse bar 190. The transverse bar 190 is connected to a parallel mounting bar 192 by two spacer bars 194 and 196. The spacer bars 194 and 196 are welded to the transverse bar 190 and the mounting bar 192. The mounting bar 192 is received in the open side of the front cross member 152 of the slider assembly 82. A retainer pin 198 passes through the front cross member 152 and the mounting bar 192 to hold the mounting bar on the slider assembly 82 as shown in FIG. 2. A first rear box holder tension strap 200 has an upper end pivotally attached to the left vertical angle iron 154 of the slider assembly 82 by bolt 202 and a lower end pivotally attached to the spacer bar 194 adjacent to the transverse bar 190 by a bolt 204. A second rear box holder tension strap 206 has an upper end pivotally attached to the right vertical angle iron 158 of the slider assembly 82 by a bolt 208 and a lower end pivotally attached to the spacer bar 196 adjacent to the transverse bar 190 by a bolt 210. The first and second tension straps 200 and 206 hold the transverse bar 190 and the mounting bar 192 at substantially the same vertical height when the mounting bar is positioned within the front cross member 152 as explained above.

The transverse bar 190, as shown in the drawing, is a square tube. A left square bar 212 is telescopically received in one end of the bar 190 as shown in FIG. 2. A right square bar 214 is telescopically received in the other end of the transverse bar 190. A tailgate pivot pin receiving sleeve 216 is welded to a forward side wall adjacent to the outer end of the left square bar 212 and the right square bar 214. The sleeves 216 have bores 218 which are sufficiently large to accept the tailgate pivot studs on the side walls and to the rear of the floor of most pick-up truck boxes. These sleeves 216 could also be welded to the outboard end surfaces of the left and right bars 212 and 214 if desired. The sleeves 216 could also be replaced by bores in the outer ends of the bars 212 and 214 if desired. The sleeves 216 are secured to a truck box by being moved into axial alignment with the tailgate pivot studs 215 of a truck box 12. The bars 212 and 214 are then slid out of the transverse bar 190 until each sleeve 216 telescopically receives one of the tailgate pivot studs 215. Clamping bolts 220 and 222 are then tightened to hold the sleeves 216 apart and retain both tailgate pivot studs 215 within the sleeves. The clamping bolts 220 and 222 and telescoping bars 212 and 214 permit adjustment to accommodate pick-up truck boxes 12 with different tailgate widths. Pick-up truck boxes 12 without tailgate pivot studs can be lifted by attaching plates with substitute studs to the box. Plates with substitute studs can be attached to a pick-up cargo box 12 by bolts that pass through existing holes or through new holes drilled through the box.

The box front holder 188 includes a compression beam assembly 224, a tension beam assembly 226 and a front transverse beam assembly 228. The compression beam assembly 224 includes a pair of parallel spaced apart angle irons 230 and 232 with their rear ends pivotally attached to a block 234 by a pivot pin 236 for pivotal movement about a transverse horizontal axis. The block 234 is welded to the front cross member 150 of the slider assembly 82. A square tube 238 is positioned between the front ends of the angle irons 230 and 232 and welded to both angle irons. A plate member 240 is welded to the angle iron 230. A plate member 242 is spaced from and parallel to the plate member 240 and welded to the angle iron 232. A first length adjustment tube 246 is telescopically received in the square tube 238. A clamp bolt 248 holds the adjustment tube 246 in a chosen position relative to the square tube 238. A second length adjustment tube 250 is telescopically received in the first length adjustment tube 246. A clamp bolt 252 holds the second length adjustment tube 250 in a chosen position relative to the first length adjustment tube 246.

Figure 8:
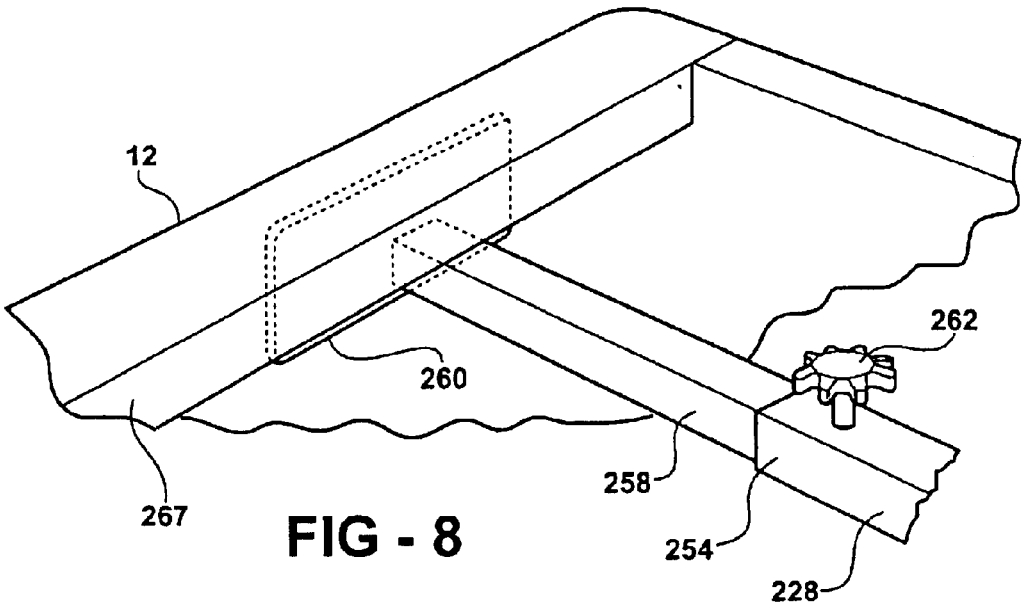
FIG. 8 is an enlarged perspective view of the left front corner of a pick-up cargo box, the front transverse tube, left side bar and the left box side rail engaging plate with parts broken away.

The front transverse beam assembly 228 includes a front transverse tube 254. A center portion of the front transverse tube 254 is pivotally connected to the forward end of the second length adjustment tube 250 by a pivot pin 256. The pivot pin 256 permits the front transverse beam assembly 228 to pivot about a transverse horizontal pivot axis. A left side bar 258 is telescopically received in a left end of the front transverse tube 254 as shown in FIG. 8. A left box side rail engaging plate 260 is welded to the free end of the left side bar 258. A clamp bolt 262 holds the bar 258 in a chosen position relative to the transverse tube 254. A right side bar, identical to the left side bar 258, is telescopically received in the right end of the front transverse tube 254. A right box side rail engaging plate 266 is welded to a free end of the right side bar. A clamp bolt 268 holds the bar 264 in a chosen position relative to the transverse tube 254.

Figure 4:
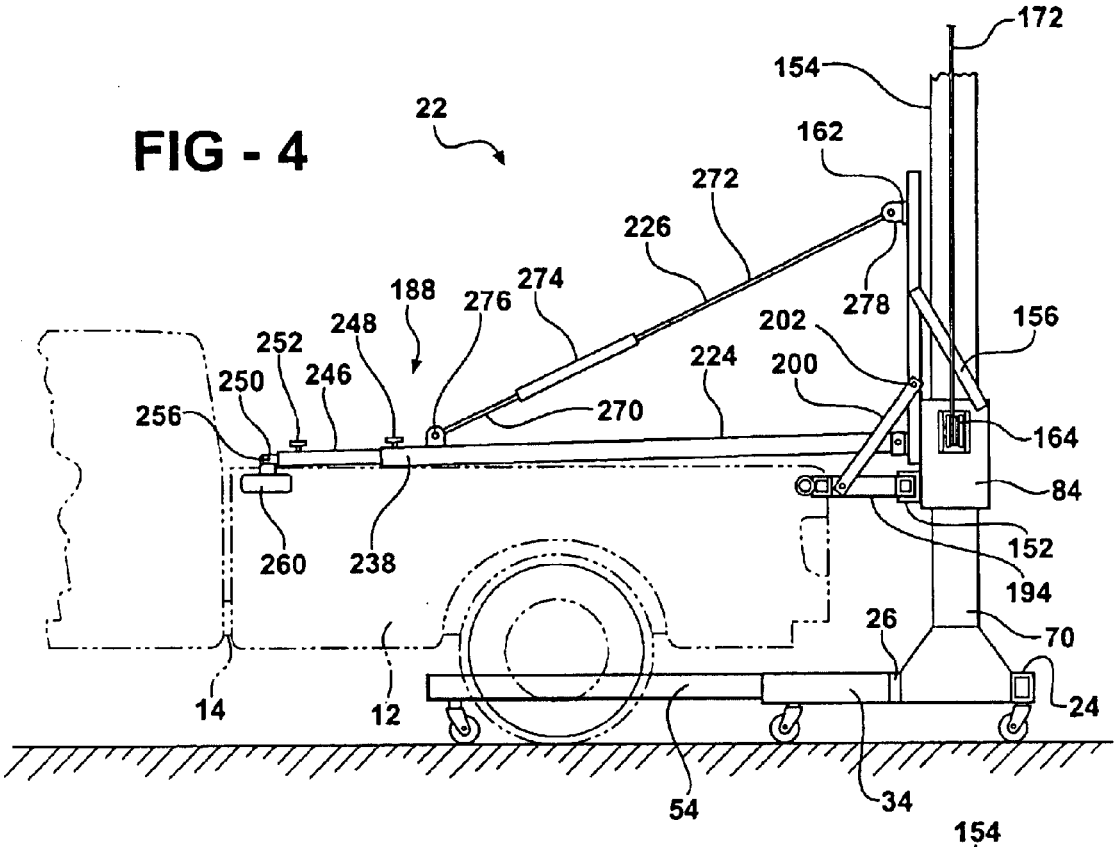
FIG. 4 is a side elevational view of the cargo box removal tool connected to a pick-up truck shown in broken lines and with parts broken away.
Figure 5:
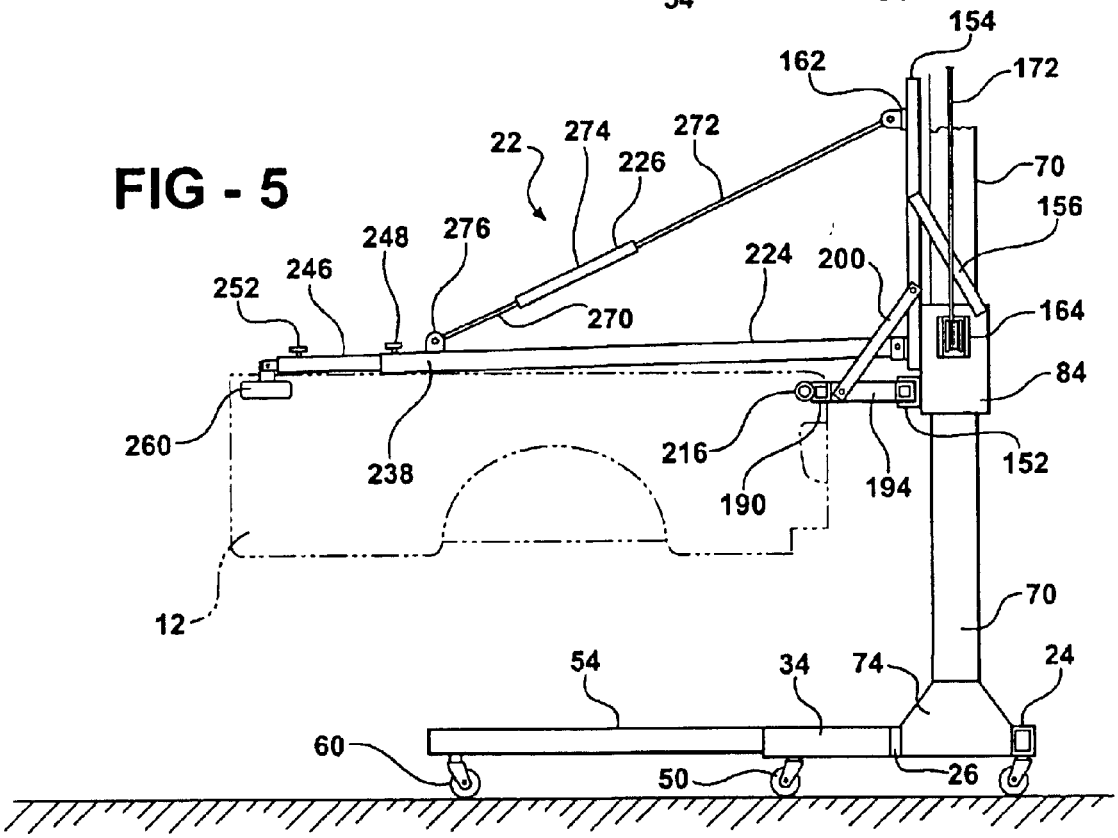
FIG. 5 is a side elevational view of the cargo box removal tool, with parts broken away, holding a cargo box shown in broken lines and elevated.

The tension beam assembly 226 includes a lower threaded rod 270 and an upper threaded rod 272. Both threaded rods 270 and 272 screw into a threaded sleeve 274. The lower end of the lower threaded rod 270 is pivotally attached to the plate members 240 and 242 by a pivot pin 276, as shown in FIGS. 4 and 5. The pivot pin 276 permits pivotal movement about a transverse horizontal axis. The upper end of the upper threaded rod 272 is T-shaped. The long threaded portion of the rod 272 passes into a slot in a forked member 278 welded to the horizontal cross bar 162 on the upper portion of the slider assembly 82. The cross bar of the T-shaped end of the upper rod 272 is held by the forked member 278 thereby preventing rotation of the upper threaded rod 172 about the axis of the threaded portion. Rotating the sleeve 274 in one direction shortens the tension beam assembly 226 and raises the front transverse beam assembly 228. Rotation of the sleeve 274 in the other direction lengthens the tension beam assembly 226 and lowers the front transverse beam assembly 228.

During use of the cargo box removal tool 10, the carriage 16 is moved to a position at the rear of a pick-up truck box. 12 with the tailgate removed. The sleeves 216 of the box rear holder 186 are moved into axially alignment with tailgate pivot studs 215 by moving the carriage 16 on the caster wheels 46, 48, 50, 52, 60 and 68 and moving the slider assembly 82 along the mast assembly to the correct vertical position. The left and right square bars 212 and 214, shown in FIG. 2, are then moved laterally outward to receive the tailgate pivot studs 215 in the bores 218 in the sleeves 216. Clamp bolts 220 and 222 are than tightened to insure the tailgate pivot studs cannot come out of a sleeve bore 218.

The threaded sleeve 274 of the tension beam 226 is rotated as required to vertically position the front transverse tube 254 of the front transverse beam assembly 228 inside the pick-up truck box. The first length adjustment tube 246 and the second length adjustment tube 250 of the compression beam assembly 224 are adjusted to position the first transverse beam assembly 228 in a fore and aft direction relative to the truck box. The nominal length of most pick-up truck boxes 12 is six feet or eight feet. However, there are truck boxes that are longer than eight feet as well as ones that are shorter than six feet. The length adjustment tubes 246 and 250 provide a range of adjustments sufficient to accommodate a wide range of cargo box lengths. The side bars 258 are slid outward in the front transverse tube 254 to move the side rail engaging plates 260 and 266 into vertical alignment with the side rails 267 of a cargo box 12 as shown in FIGS. 4, 5, and 8. The threaded sleeve 274 is rotated to shorten the length of the tension beam assembly 226 and raise the side rail engaging plates 260 and 266 into engagement with the underside of the box side rails 267. The clamp bolts 262 and 268 are tightened to hold the plates 260 and 266 in selected positions relative to each other. Bumpers, made of rubber or other resilient material, can be attached to the plates 260 and 266 to protect the side walls of a cargo box from damage. If the truck box does not have the normal upper side wall construction, the plates 260 and 266 can be attached to the truck box by bolts.

After the box rear holder 186 and the box front holder 188 are attached to and moved into engagement with a pick-up truck box as described above, the slider assembly 82 can be raised and lowered by the winch assembly 164 to raise and lower the truck box 12. The carriage 16 is manually moveable on the caster wheels, 46, 48, 50, 52, 60 and 68 to move a truck box away from or on to a truck frame. Handles 282 and 284 are attached to the slider assembly 82 for moving the carriage 16 to various locations. Repairs to the truck box 12 can be made while the box is supported by the cargo box removal tool 10.

The cargo box removal tool 10 can also handle utility boxes, with compartments for tools, hardware and other equipment, that are attached to truck frames.

Figure 3:
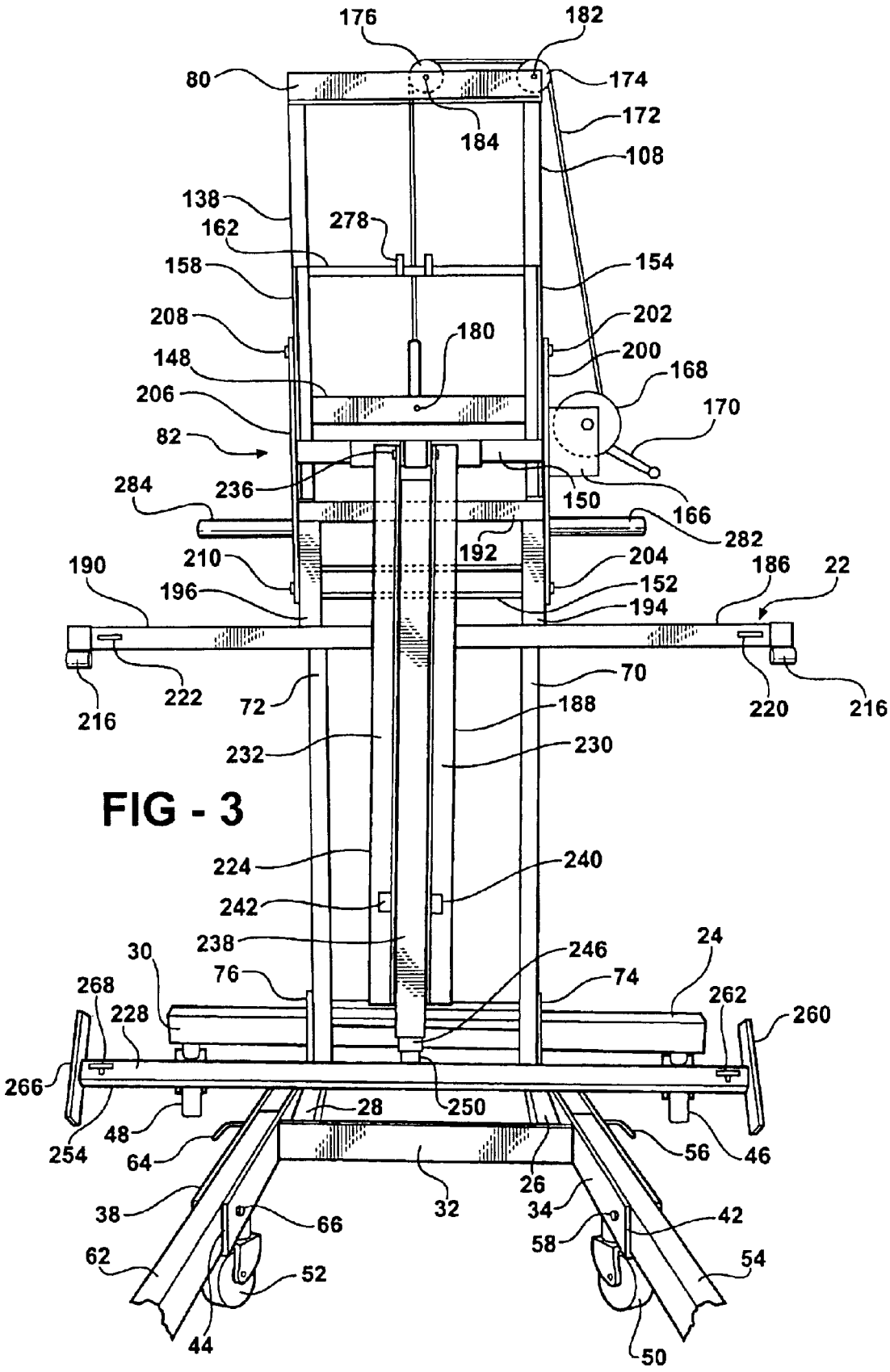
FIG. 3 is a perspective view of the cargo box removal tool with the truck box rear holder and the front holder both in storage positions and with parts removed for clarity.
Figure 6:
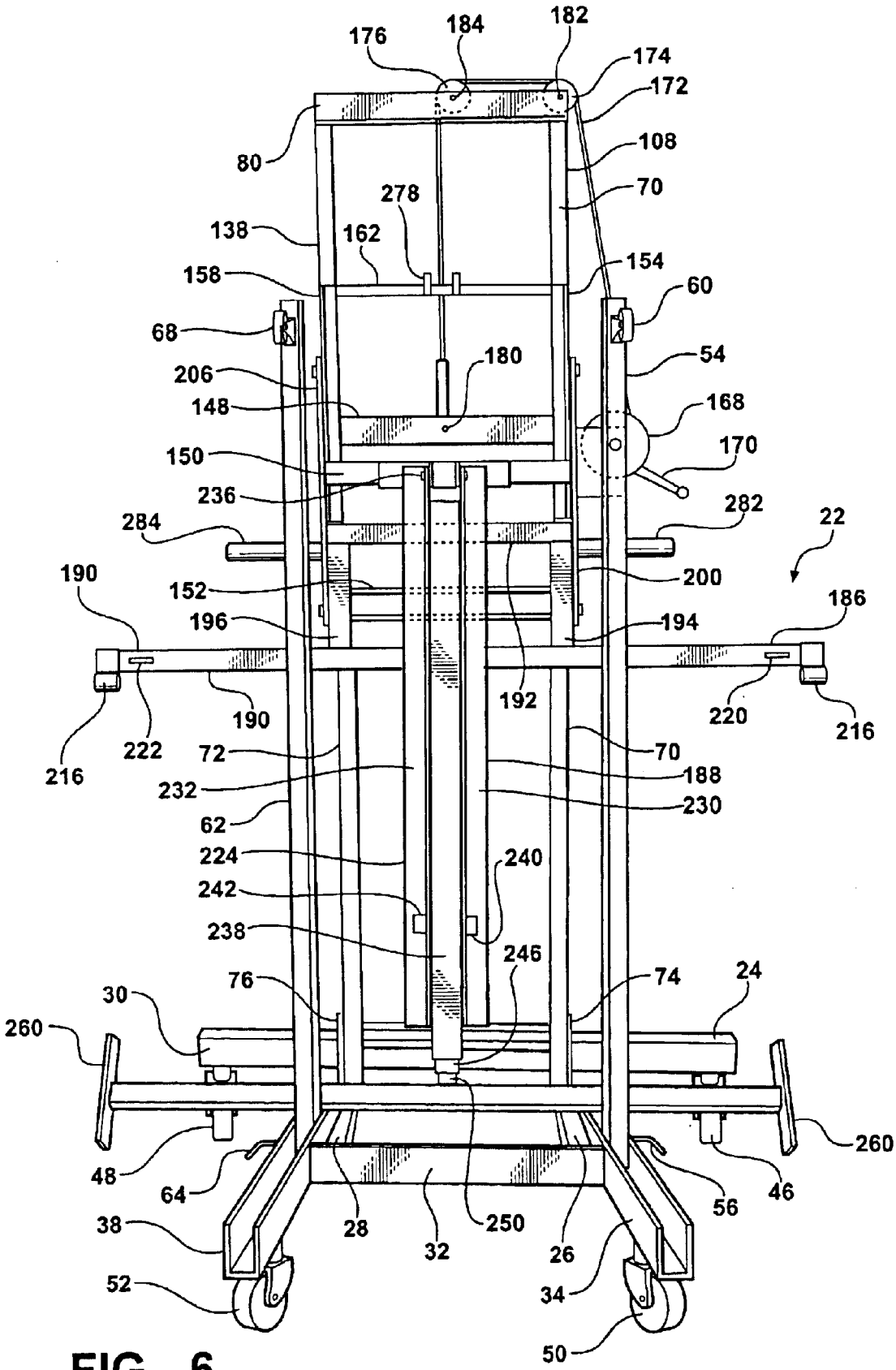
FIG. 6 is a perspective view, similar to FIG. 3, with the carriage outriggers in a storage position.
Figure 7:
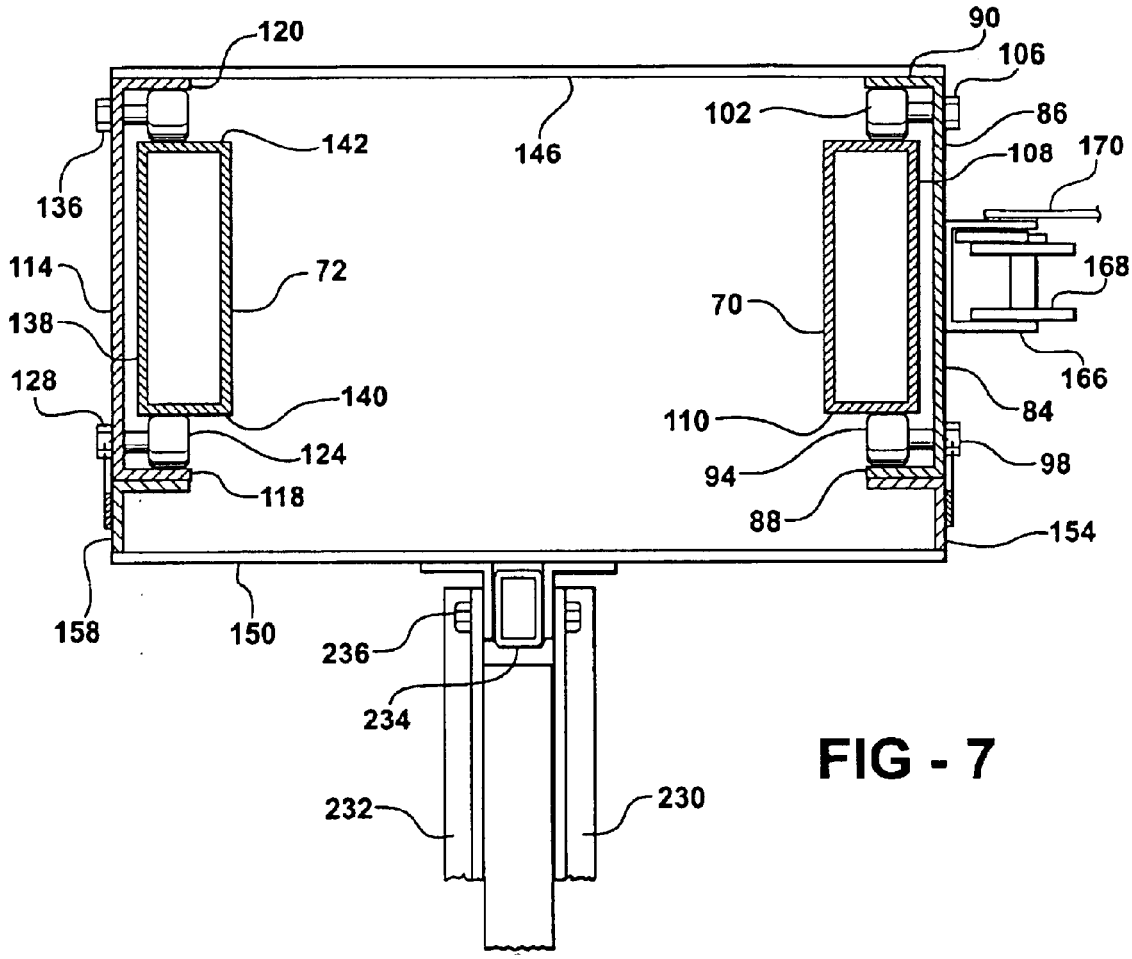
FIG. 7 is an enlarged sectional view of the slider assembly.

The cargo box removal tool 10 is storable in a relatively small space. To store the tool 10, the retainer pin 198 is removed, the mounting bar 192 is removed from the channel shaped front cross member 152, and the transverse bar 90 is pivoted to a position against the mast tubes 70 and 72 as shown in FIG. 1. It may be necessary to loosen the bolts 202, 204, 208 and 210 to pivot the tension straps 200 and 206 and move the transverse bar 190 of the box rear holder 186 to a position against the mast tubes 70 and 72. The slider assembly 82 is raised by the winch assembly 164 and the rod 272 of the tension beam assembly 226 is released from the forked member 278 on the cross bar 162. The front transverse tube 254 of the front transverse beam assembly 228 pivots about the pivot pin 236 and moves to a position between the mast tubes 70 and 72 and the pivot pins 56 and 64 and above the fore and aft tubular beams 26 and 28 of the carriage 16 as shown in FIG. 3. If desired, the front transverse tube 254 of the front transverse beam assembly 228 can rest on the beams 26 and 28. The outrigger lock pins 58 and 66 are removed from the outriggers 54 and 62 and the outriggers are pivoted about their respective pivot pins 56 and 64 to generally vertical storage positions as shown in FIG. 6. In the storage position, the outriggers 54 and 62 rest against the transverse bar 190 of the box rear holder 186.

The disclosed embodiment is representative of a presently preferred form of the invention, but is intended to be illustrative rather than definitive thereof. The invention is defined in the claims.

What is claimed is:

1. A pick-up truck box removal tool comprising:

a carriage frame;

a generally vertical mast having a lower mast end secured to the carriage frame and an upper mast end;

a slider assembly mounted on the generally vertical mast and slidable along at least a portion of the generally vertical mast between the lower mast end and the upper mast end;

a slider actuator carried by the carriage frame and connected to the slider assembly and wherein the slider actuator is operable to lift and lower the slider assembly on the generally vertical mast;

a truck box rear holder including a rear transverse bar connected to the slider assembly and held in a fixed position relative to the slider assembly, a left tailgate pivot stud receiver adjustable mounted on the rear transverse bar, and a right tailgate pivot stud receiver adjustable mounted on the rear transverse bar;

a truck box front holder including an adjustable length beam pivotally attached to the slider assembly and pitvotable about a transverse horizontal front holder axis, a transverse front pole pivotally attached to the adjustable length beam, a left truck box side rail engaging plate connected to the transverse front pole and laterally adjustable relative to the transverse front pole and a right truck box side rail engaging plate connected to the transverse front pole and laterally adjustable relative to the transverse front pole;

an actuator connected to the adjustable length beam and wherein the actuator pivots the adjustable length beam relative to the slider assembly to raise and lower the left and right truck box side rail engaging plates.

2. A pick-up truck box removal tool, as set forth in claim 1 wherein the carriage frame is mounted on a plurality of caster wheels.

3. A pick-up truck box removal tool, as set forth in claim 2 including a pair of outrigger members pivotally attached to the carriage frame and pivotal between a generally horizontal position locked to the carriage frame by at least one outrigger lock and a generally vertical storage position; and a caster wheel mounted on an outboard end of each of the pair of outrigger members.

4. A pick-up truck box removal tool, as set forth in claim 1, wherein the generally vertical mast includes two spaced apart parallel members both of which have a lower mast end secured to the carriage frame.

5. A pick-up truck box removal tool, as set forth in claim 1, wherein the slider actuator includes a winch mounted on the slider assembly and having a winch cable that extends from a winch drum, around a cable guide pulley journaled on the generally vertical mast, and downward to the slider assembly and has a cable free end anchored to the slider assembly.

6. A pick-up truck box removal tool, as set forth in claim 1, wherein the truck box rear holder limits a truck box to pivotal movement about a truck box horizontal axis relative to the slider assembly.

7. A pick-up truck box removal tool, as set forth in claim 1, wherein the linear actuator includes a first threaded member, a second threaded member, and a threaded sleeve with a first end female threads that receive the first threaded member, a second end female threads that receive the second threaded member, and wherein rotation of the threaded sleeve in one direction shortens the linear actuator and rotation of the threaded sleeve in another direction lengthens the linear actuator.

8. A pick-up truck box removal tool, as set forth in claim 1, wherein the rear transverse bar connected to the slider assembly is a rear transverse tube that telescopically receives the left tailgate pivot stud receiver and the right tailgate pivot stud receiver.

9. A pick-up truck box removal tool, as set forth in claim 1, wherein the transverse front pole is a transverse front tube that telescopically receives a left side bar attached to the left truck box side rail engaging plate and that telescopically receives a right side bar attached to the right truck box side rail engaging plate.

10. A pick-up tool box removal tool comprising:

a carriage frame supported by a plurality of caster wheels;

a generally vertical mast having a lower mast end secured to the carriage frame and an upper mast end;

a slider assembly mounted on the generally vertical mast and slidable along at least a portion of the generally vertical mast between the lower mast end and the upper mast end;

a winch mounted on the slider assembly and having a winch cable that extends from a winch drum and around a cable guide pulley journaled on the generally vertical mast and wherein a cable free end of the winch cable is anchored on the slider assembly;

a truck box rear holder including a rear transverse bar connected to the slider assembly and held in a fixed position relative to the slider assembly, a left tailgate pivot stud receiver adjustably mounted on the rear transverse bar for transverse positioning relative to the rear transverse bar and a right tailgate pivot stud receiver adjustably mounted on the rear transverse bar for transverse positioning relative to the rear transverse bar;

a truck box front holder including a front beam with a front beam rear end pivotally attached to the slider assembly and pivotable about a transverse horizontal front holder axis, at least one length adjustment pole adjustably connected to the front beam, a transverse front pole pivotally attached to the at least one length adjustment pole and movable toward and away from the slider assembly with the at least one length adjustment pole, a left truck box side rail engaging plate adjustably connected to the transverse front pole, a right truck box side rail engaging plate adjustably connected to the transverse front pole, and a linear actuator with a first end connected to the slider assembly and a second end connected to the front beam at a position spaced from the transverse horizontal front holder axis; and wherein changing the length of the linear actuator pivots the front beam about the transverse horizontal front holder axis and moves the transverse front pole vertically.

11. A pick-up truck box removal tool, as set forth in claim 10 including a pair of outrigger members pivotally attached to the carriage frame and pivotal between a generally horizontal position locked to the carriage frame by at least one outrigger lock and a generally vertical storage position; and a caster wheel mounted on an outboard end of each of the pair of outrigger members.

12. A pick-up truck box removal tool, as set forth in claim 10, wherein the generally vertical mast includes two spaced apart parallel members both of which have a lower mast end secured to the carriage frame.

13. A pick-up truck box removal tool, as set forth in claim 10, wherein the truck box rear holder limits a truck box to pivotal movement about a truck box horizontal axis relative to the slider assembly.

14. A pick-up truck box removal tool, as set forth in claim 10, wherein the linear actuator includes a first threaded member, a second threaded member, and a threaded sleeve with a first end female threads that receive the first threaded member, a second end female threads that receive the second threaded member, and wherein rotation of the threaded sleeve in one direction shortens the linear actuator and rotation of the threaded sleeve in another direction lengthens the linear actuator.

15. A pick-up truck box removal tool, as set forth in claim 10, wherein the rear transverse bar connected to the slider assembly is a rear transverse tube that telescopically receives the left tailgate pivot stud receiver and the right tailgate pivot stud receiver.

16. A pick-up truck box removal tool, as set forth in claim 10, wherein the transverse front pole is a transverse front tube that telescopically receives a left side bar attached to the left truck box side rail engaging plate and that telescopically receives a right side bar attached to the right truck box side rail engaging plate.

17. A method of lifting a pick-up truck cargo box from a truck frame with a carriage frame mounted on wheels, a generally vertical mast connected to the carriage frame, and a slider assembly slidably mounted on the generally vertical mast comprising:

moving the carriage frame into alignment with the pick-up truck cargo box;

pivotally attaching a rear end of the pick-up truck cargo box to the slider assembly for pivotal movement about a transverse horizontal tailgate axis;

moving a left truck box side rail engaging plate and a right truck box side rail engaging plate into positions to support a front portion of the pick-up truck cargo box;

holding the position of the left and right truck box side rail engaging plates relative to the slider assembly; and moving the slider assembly upward on the generally vertical mast to simultaneously lift the rear end of pick-up truck cargo box and the front portion of the pick-up truck box.

* * * * *